US005135017A

United States Patent [19]

Fujiyama

[11] Patent Number: 5,135,017

[45] Date of Patent: Aug. 4, 1992

[54] UMBRELLA COVER

[75] Inventor: Taiji Fujiyama, Tokyo, Japan

[73] Assignee: Tokyo Nagai Co., Ltd., Tokyo, Japan

[21] Appl. No.: 599,710

[22] Filed: Oct. 18, 1990

[30] Foreign Application Priority Data

Oct. 21, 1989 [KR] Rep. of Korea ..... 1989-15361
Mar. 5, 1990 [JP] Japan ..... 2-51824

[51] Int. Cl.[5] ..... A45B 25/28
[52] U.S. Cl. ..... 135/34.2; 135/48
[58] Field of Search ..... 220/8; 135/48, 34.2, 135/16

[56] References Cited

U.S. PATENT DOCUMENTS

| | | | |
|---|---|---|---|
| 108,798 | 11/1870 | Keenan | 135/48 |
| 337,145 | 3/1886 | Ghezzi | 135/48 |
| 785,938 | 3/1905 | Epstein | 135/34.2 |
| 3,114,468 | 12/1963 | Quase | 220/8 |
| 4,624,382 | 11/1986 | Tontarelli | 220/8 |
| 4,973,189 | 11/1990 | Bechtold | 220/8 |

FOREIGN PATENT DOCUMENTS

| | | | |
|---|---|---|---|
| 34320 | 9/1905 | Fed. Rep. of Germany | 135/34.2 |
| 215384 | 10/1909 | Fed. Rep. of Germany | 135/34.2 |
| 339364 | 4/1936 | Italy | 135/34.2 |

*Primary Examiner*—Henry E. Raduazo
*Attorney, Agent, or Firm*—Fleit, Jacobson, Cohn, Price, Holman & Stern

[57] ABSTRACT

In an umbrella cover, in which each of a plurality of short connector cylinders has its diameter gradually decreased, inner protuberances are provided at the inner circumferences of the small diameter sides or ends and outer protuberances are provided at the outer circumferences of the large diameter sides or ends of the cylinders. The cylinders are concentrically fitted to each other, and each of the adjacent connector cylinders receives the inner protuberance of an inner connector cylinder. Each of the connector cylinders is provided at its inner surface adjacent to its large diameter end, with abutting protuberances projected in a circumferential direction. Additionally, at small diameter positions, spaced apart from each of the abutting protuberances by a predetermined amount, each of the connector cylinders is provided with a plurality of latching protuberances projected along a circumferential direction. Each of the latching protuberances has a lower projecting height than that of the abutting protuberances. Each of the abutting protuberances and each of the latching protuberances is arranged such that the outer protuberances of the inner connector cylinder are engaged with the latching protuberances of the outer connector cylinder at once when the extending or retracting cover is retracted. As the cover is further pushed toward its retracting direction under this condition, the outer protuberances ride over the latching protuberances and fit between the abutting protuberances and the latching protuberances so as to prevent both a dropping-off of the extending or retracting cover in its retracting direction and a sliding-off of the extending or retracting cover.

4 Claims, 12 Drawing Sheets

A1
5a
7a
6a
3a
6b
7b
5b
4a
3b
5c
6c
4b
7c
3c

A1
Y1 Y2
3a
3b
3c

A1
5a
6a
7a
6b
7b
6c
7c
3a
5b
3b
5c
3c

UMBRELLA COVER

BACKGROUND OF THE INVENTION

1. Field of the Invention

This invention relates to an umbrella cover which is fixed to a top end of an umbrella shaft. The umbrella cover covers an outer circumference of an umbrella cloth when the umbrella is closed and is capable of keeping the umbrella cloth protected and "waterproof" so that dripping is prevented.

2. Description of Related Art

When a wet umbrella is brought into a building, a vehicle or the like, the umbrella may contact clothes and cause them to become wet. Also, rain water may drip from the umbrella and wet a floor. It is, therefore, necessary to provide a waterproof means for preventing this unfavorable state.

As a conventional waterproofing method, an outer circumference of an umbrella cloth, during a closed state of the umbrella, is covered by either an umbrella cover used with the umbrella or a waterproof cover, made from vinyl and the like, which is available at an entrance or exit of a building on a rainy day.

However, a certain type of umbrella is not provided with such an umbrella cover, and even if the cover is attached to it, the cover is frequently lost or troublesome to handle, resulting in that the cover may not accompany the umbrella as usual. Consequently, this type of cover can not provide effective waterproofing.

The latter waterproof cover, being made of vinyl, is easily deformed, due to its soft and weak characteristic. Also, its fitting or removal may be troublesome and, at the same time, its extreme end may be broken by a tip end of the umbrella shaft to cause a leakage of water. Further, since it is difficult to make repeated use of it, the cover is frequently disposed of and so may generate a loss of natural resources, waste material and the like. In addition, the cover is not available at just any place and so may not be utilized when required. Also, even if the cover is made available by a user himself or herself, together with the umbrella, a problem similar to that found in an accessory umbrella cover may be generated.

In order to resolve problems found in the conventional type of waterproof means, there have been proposed various umbrella covers in Japanese Laid-Open Application No. Sho 53-30965, Japanese Publication No. Sho 52-25329 and Japanese Publication No. Sho 57-27924, for example. The covers for umbrellas are constructed such that each of a plurality of short connector cylinders, having a diameter which is gradually decreased, is concentrically fitted with another. Adjoining ends of each of the connector cylinders are connected to each other to form an extendable or retractable cylinder; this extending or retracting cylinder is fitted to the umbrella shaft through an umbrella shaft fixing part.

The umbrella cover is normally fixed to the tip end of the umbrella shaft when in its retracted short state. When used, it is extended to cover an outer circumference of the umbrella cloth of the wet umbrella while the umbrella is closed so as to provide a waterproof state.

However, in the conventional type of umbrella cover, the following problems may occur, due to the fact that such a cover has a connection structure in which a projecting edge, formed at an inner circumference of an edge of small diameter of an outer connector cylinder, engages with a projecting edge formed at an outer circumferences of a large diameter edge of an inner connector cylinder so as to prevent each of the connector cylinders from being pulled out of the other when the extending or retracting cylinders are extended.

First, in a conventional type of umbrella cover, there is no engaging part provided until the cover is completely extended or retracted; the cover is held with only a frictional force, so that it may easily slide off in its extending direction. If an attempt is made to open the closed umbrella while a top end of the umbrella shaft faces upward, the umbrella is prohibited form opening by the dropped extending or retracting cylinders. Then the umbrella may not be opened. Thus, the umbrella should be opened while a top end of the umbrella is placed downward, and its operation is troublesome.

In this type of umbrella cover, a flexible plastic material, having a thickness which is made as thin as possible, is applied to the connector cylinders in order to provide a light weight or a high strength. Consequently, the prior art connection structure, in an engaging operation, has an insufficient engaging and holding force. Due to this fact, as the outermost connector cylinder is held and slid in its extending or retracting direction when the cylinder is extended or retracted with strong force, there is a possibility that the engaged states between the umbrella shaft fitting part and the extending or retracting cylinders, or between each of the connector cylinders, will be released, and thus, they are easily pulled out and disassembled.

In addition, since the prior art umbrella cover has no part for accumulating rain water, the water drips adhering to the umbrella and then dripping are discharged from the extreme end of the extended or retracted cylinder so that there is a disadvantage in that the umbrella, after its use, has to stored in a place where the floor could be allowed to become wet.

In view of the foregoing, it is an object of the present invention to provide an umbrella cover in which engagement and holding between connector cylinders are improved.

It is another object of the present invention to provide an umbrella cover which is suitable for portable use together with the umbrella and which can be easily handled and used.

It is a still further object of the present invention to provide an umbrella cover having a manufacturing cost which is less expensive.

It is yet a further object of the present invention to provide an umbrella cover in which rain water adhering to the umbrella is stored, when the umbrella is closed, to prevent the rain water from leaking around the umbrella. The accumulated rain water is discharged at a proper time.

Other objects and features of the present invention will become apparent from the detailed description of the preferred embodiments of the present invention when considered together with the accompanying drawings.

SUMMARY OF THE INVENTION

A first feature of the present invention is the provision of an umbrella cover in which each of a plurality of short connector cylinders, having their diameters gradually decreased and provided with inner protuberances at the inner circumferences of their small diameter sides or ends and outer protuberances at the outer circumferences of their large diameter sides or ends, are concentrically fitted to each other. Each pair of adjacent connector cylinders has the inner protuberance of an outer connector cylinder engaged with the outer protuberance of an inner connector cylinder, and each of the connector cylinders is connected to the other. The longitudinal pulling out movement of each cylinder is stopped relative to the other to form an extending or retracting cover. The connector cylinder, fitted to the innermost circumference of this extending or retracting cover and placed at the most extreme end when extended, has an umbrella shaft fitting part to be fixed to an extreme end of the umbrella shaft. The extending or retracting cover is normally fitted to the extreme end of the umbrella shaft through the umbrella shaft fitting part in its retracted state, and covers the outer circumference of the cloth of the closed umbrella while in its extended state during its use to provide a waterproof state. Each of the connector cylinders is provided with, at its inner surface and adjacent to its large diameter end, abutting protuberances projecting in a circumferential direction. Each of the connector cylinders is further provided, at small diameter positions spaced apart from each of the abutting protuberances by a predetermined amount, with a plurality of latching protuberances projecting along a circumferential direction and having a lower projecting height than that of the abutting protuberances. Each of the abutting protuberances and each of the latching protuberances is arranged such that the outer protuberances of an inner connector cylinder are engaged with the latching protuberances of an outer connector cylinder at once when the extending or retracting cover is retracted. As the cover is further pushed toward its retracting direction under this condition, the outer protuberances ride over the latching protuberances and fit between the abutting protuberances and the latching protuberances so as to prevent a dropping-off of the extending or retracting cover in its retracting direction and a sliding-off of the extending or retracting cover in its extending direction after it reaches the retracted state. The umbrella shaft fitting part includes an umbrella shaft fixing cylinder, arranged at one end while always being stored within the innermost circumferential connector cylinder, and a sliding cylinder having an outer circumferential surface which is slidably fitted to the innermost circumferential connector cylinder when the extending or retracting cover is retracted. Outer circumferences at both ends of the umbrella shaft fitting cylinder are provided with annular protuberances for use in engaging with each of the inner protuberances of the innermost sliding connector cylinder.

A second feature of the present invention is that a water storing chamber for storing rain water is formed within a sliding cylinder at the umbrella shaft fitting part in a first umbrella cover. The umbrella shaft fixing cylinder is provided with a communication port for permitting the water droplets adhered to the umbrella to drip away by communicating the extending or retracting cover with the water storing chamber. The sliding cylinder is further provided with a water drain port for discharging the stored rain water by communicating the water storing chamber with the external part.

A third feature of the present invention is that the other end of the sliding cylinder in a second umbrella cover is covered with a water drain cap for properly discharging the rain water in the water storing chamber by opening or closing the water discharging port.

A fourth feature of the present invention is that the umbrella shaft fixing cylinder and the sliding cylinder in first to third umbrella covers are formed separately in advance. The umbrella shaft fixing cylinder is inserted at a large diameter part of the connector cylinder at the most extreme end of the extending or retracting cover and fixed, in its fitted condition, to the sliding cylinder inserted at a small diameter side of the connector cylinder.

The fifth feature of the present invention is that an outer circumference of the umbrella shaft fixing cylinder in a fourth umbrella cover is provided with an annular packing wound therearound. The umbrella shaft supporting part for supporting an extreme end of the tip end of the umbrella passing through the umbrella shaft fixing cylinder is arranged within the sliding cylinder.

A sixth feature of the present invention is that the aforesaid umbrella shaft fixing cylinder in the fourth umbrella cover is provided with an inner thread. An external thread, arranged at the umbrella shaft, is threadably engaged with the inner thread. Then, the umbrella shaft is removably connected to the umbrella shaft fixing cylinder.

BRIEF DESCRIPTION OF THE DRAWINGS

FIG. 7(*b*) is a sectional view showing a retracted state of extending or retracting cylinders.

FIG. 7(*c*) is a sectional view showing a state just before completion of the retraction of extending or retracting cylinders.

FIG. 9(*b*) is a longitudinal section of the umbrella shaft fixing part while a water drain cap is pulled out thereof.

DESCRIPTION OF THE PREFERRED EMBODIMENTS

Figure 1:
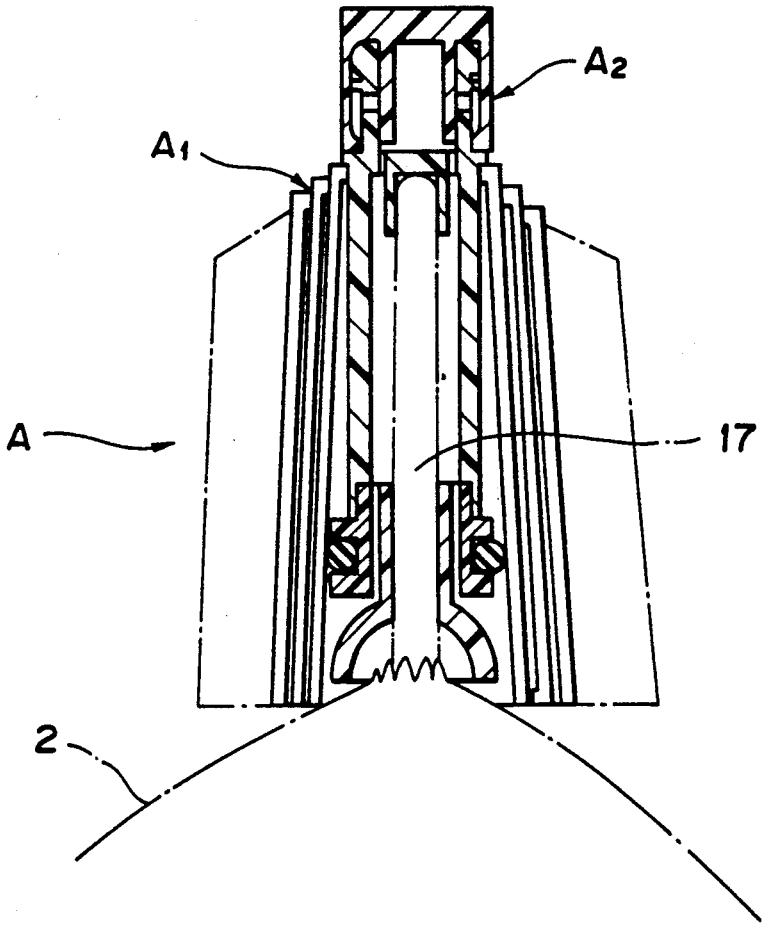
FIG. 1 is a longitudinal section of an umbrella cover, fitted to an umbrella, in its retracted state.

Referring now to the drawings, the preferred embodiments of the present invention will be described in detail.

Figure 2:
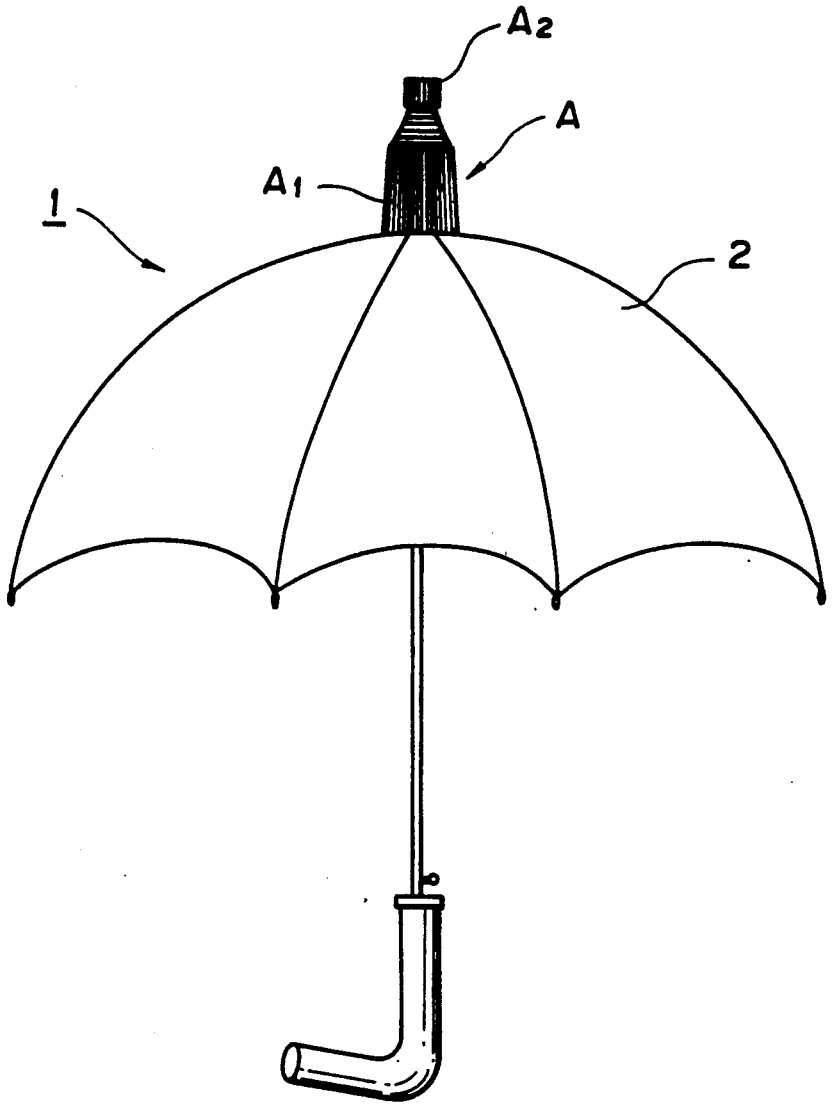
FIG. 2 is a front elevational view showing an umbrella, in its opened state, to which the retracted umbrella cover is fitted.

The umbrella cover A is comprised of an extending or retracting cover part $A_1$ and an umbrella shaft fitting part $A_2$ as shown in FIG. 1. The extending or retracting cover part $A_1$ is fitted to a top end of the umbrella shaft projected from a central part of an umbrella cloth 2 through the umbrella shaft fitting part $A_2$, as shown in FIG. 2. The extending or retracting cover part $A_1$ is held retracted (i.e., in a retracted or short length position) so as not to inhibit an opening or closing operation of the umbrella 1.

Figure 3:
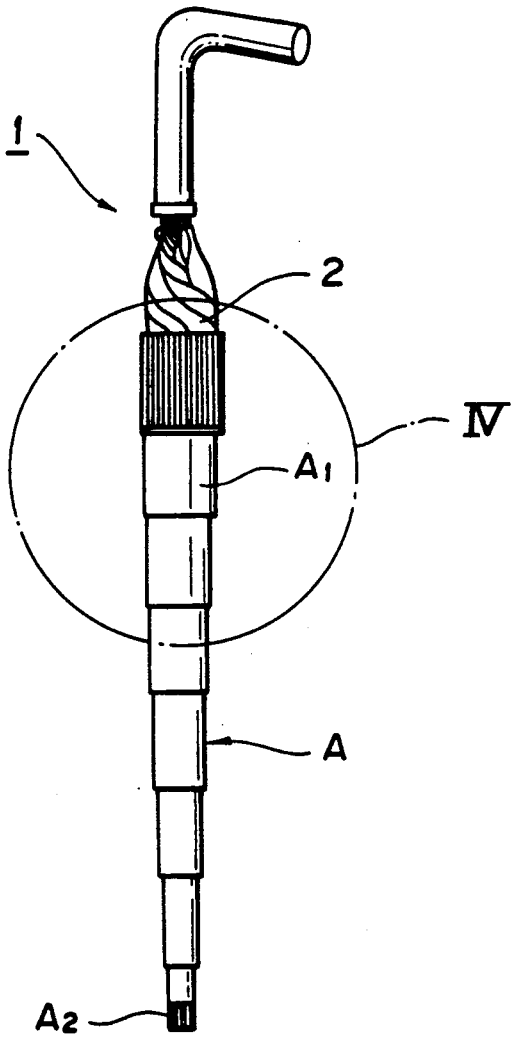
FIG. 3 is a front elevational view showing a state in which the umbrella is closed and the installed umbrella cover is extended.
Figure 4:
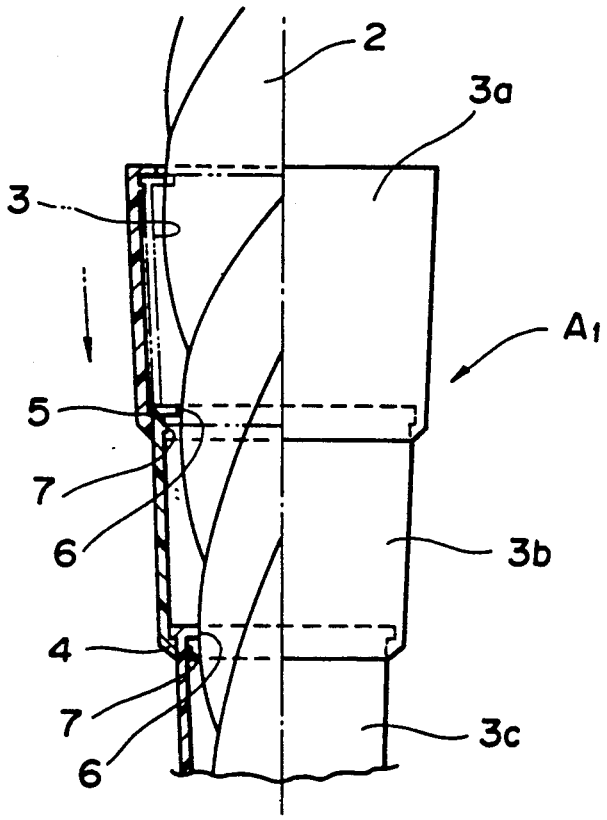
FIG. 4 is an enlarged sectional view showing portion IV of FIG. 3.

As shown in FIGS. 3 and 4, if the extending or retracting cover part $A_1$ is extended while the umbrella 1 is being closed, it is possible to cover the outer circumference of the wet umbrella cloth 2 and place the umbrella 1 in a waterproof state.

Figure 5:
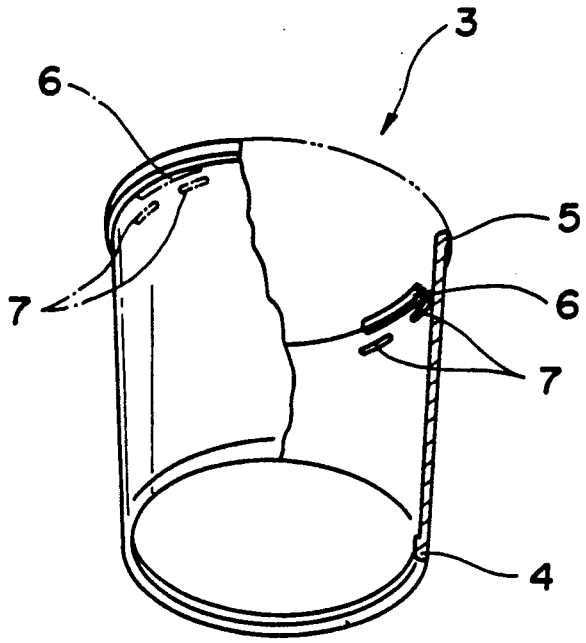
FIG. 5 is a perspective view, partly broken away, showing a connector cylinder for forming the umbrella cover.

Details of the extending or retracting cover part $A_1$ will now be described in reference to FIGS. 4 to 7. To form the extending or retracting cover $A_1$, a plurality of short connector cylinders 3 having diameters which are gradually decreased, as shown in FIG. 5, are used. The connector cylinder 3 is made of relatively soft flexible plastic material such as polypropylene, for example. An annular inner projection edge 4 is projected from an inner circumferential edge of a small diameter part or distal end of the cylinder 3, and an annular outer projection edge 5 is projected from an outer circumferential end of a large diameter or proximal end of the cylinder.

The connector cylinder 3 is provided, at its inner surface, adjacent to the large diameter end, with elongated, arcuate, abutting protuberances 6 and 6 extending in its circumferential direction. At inner positions, spaced apart from each of the abutting protuberances 6, arm oppositely arranged short arcuate latching protuberances 7 and 7 forming a set of two lines along its circumferential direction. Each of the latching protuberances 7 has a lower projection height than that of the protuberances 6.

Figure 6:
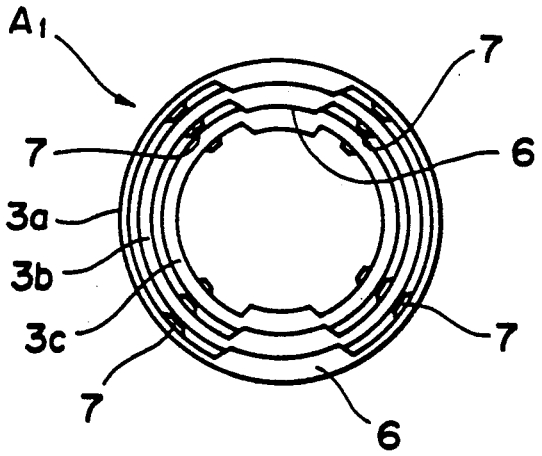
FIG. 6 is a top plan view showing an extending or retracting cover formed by connecting a plurality of connector cylinders.
Figures 7A, 7B, 7C:
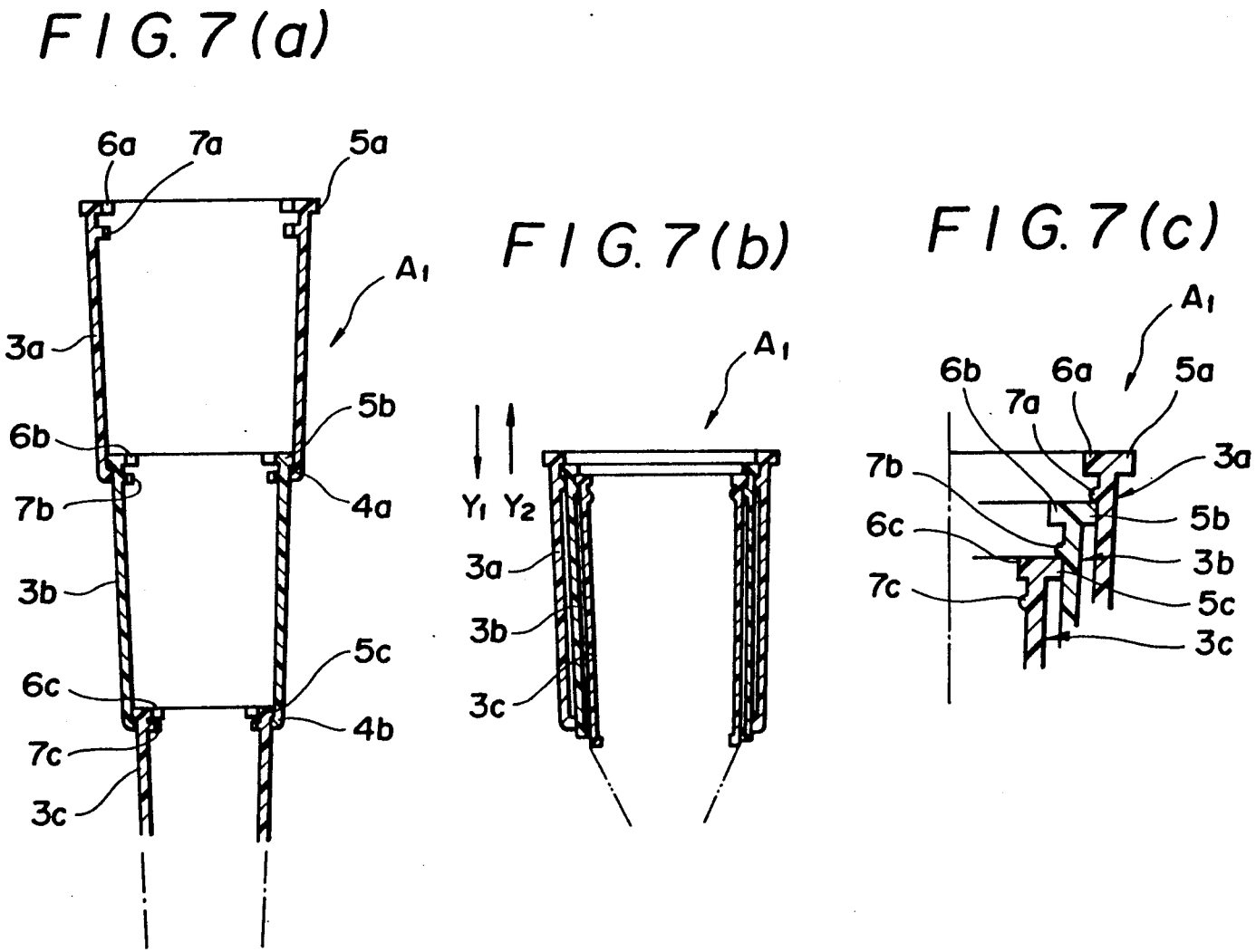
FIG. 7(*a*) is a sectional view showing an extended state of extending or retracting cylinders.
Figure 8:
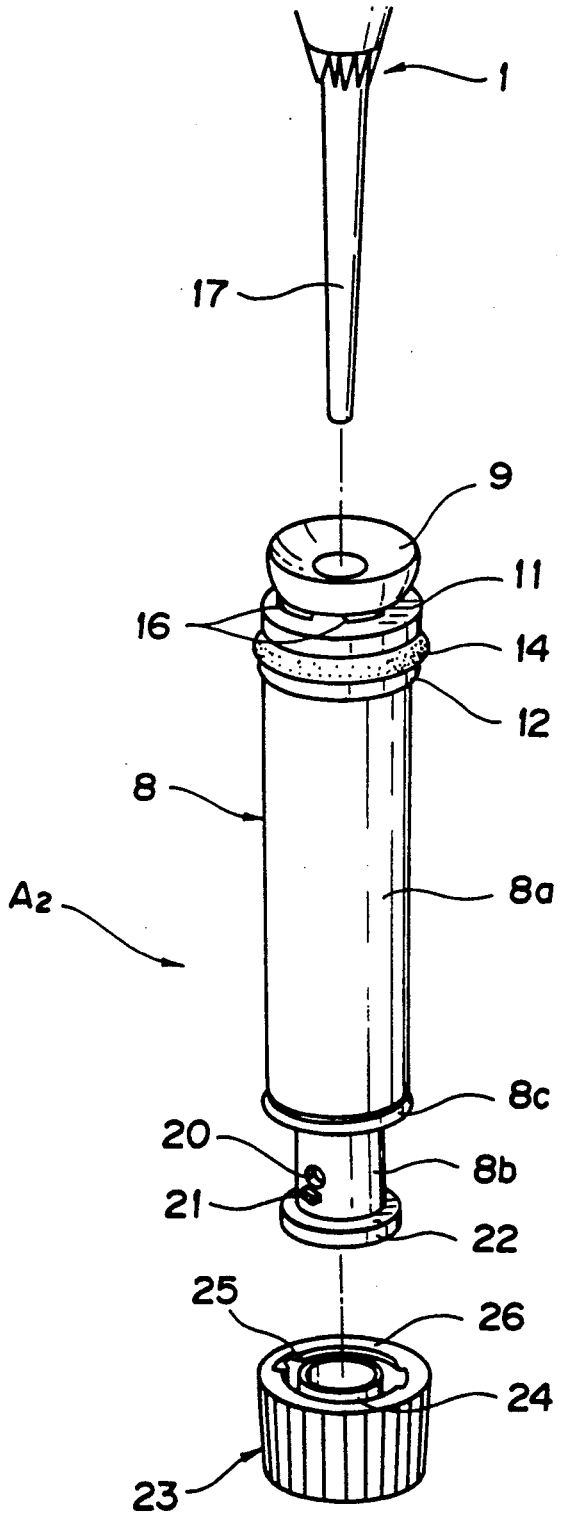
FIG. 8 is an exploded perspective view showing an umbrella shaft fixing part forming the umbrella cover.

Each of a plurality of connector cylinders 3*a*, 3*b* and 3*c* has a figure similar to those of the others. The connector cylinder diameters are gradually decreased, in sequence, and in the illustrated configuration, each connector cylinder is fitted concentrically with at least one other, as shown in FIG. 6. Each of these connector cylinders 3*a*, 3*b* and 3*c* is connected, in sequence, with at least one other. Adjoining cylinder ends are engaged with each other as shown in FIG. 7 so as to form an integral extending or retracting cover part $A_1$ which can be freely extended or retracted. As shown in FIG. 3, the length of each of the connector cylinders 3 and the number of the connector cylinders 3 are set in such a way that in the extended state of the extending or retracting cover $A_1$, the umbrella cloth 2 may be covered up to near a handle of the umbrella 1.

The extending or retracting cover part $A_1$ is made such that when each of the connector cylinders 3*a*, 3*b* and 3*c* are extended as shown in FIG. 7(*a*), an outer projecting edge 5*c* of a first connector cylinder 3*c* is engaged with an inner projecting edge 4*b* of a second connector cylinder 3*b* and an outer projecting edge 5*b* of the second connector cylinder 3*b* is further engaged with an inner projecting edge 4*a* of a third connector cylinder 3*a*, so that each of the connector cylinders 3*a*, 3*b* and 3*c*, during extension of the extending or retracting cover $A_1$, is prevented from being dropped off of the umbrella.

If each of the connector cylinders 3*a*, 3*b* and 3*c* of the extending or retracting cover part $A_1$ is retracted so as to be shortened, as shown in FIG. 7(*c*), the outer projecting edge 5*c* of the first connector cylinder 3*c* is engaged with the latching protuberance 7*b* of the outer connector cylinder 3*b*. The outer projecting edge 5*b* of the outer connector cylinder 3*b* is further engaged at once with the latching protuberance 7*a* of the outer connector cylinder 3*a*. Under this condition, when the connector cylinder is further pushed toward its collapsed or shortened direction, the outer projecting edges 5*c* and 5*b* ride over the stopper protuberances 7*b* and 7*a*, and, as is shown in FIG. 7(*b*), the outer projecting edge 5*c* is fitted between the abutting protuberance 6*b* and the latching protuberance 7*b*. Then, the outer projecting edge 5*b* is fitted between the abutting protuberance 6*a* and the latching protuberance 7*a*. With this arrangement, the extending or retracting cover part $A_1$ is set such that each of the connector cylinders 3*a*, 3*b* and 3*c*, during a retracting operation, is prevented from dropping off toward its retracting direction $Y_1$. At the same time, each of the connector cylinders 3*a*, 3*b* and 3*c*, after a retracting operation, is prevented from slipping off toward its extending direction $Y_2$.

A detailed portion of the umbrella shaft fitting part $A_2$ will now be described, making reference to FIGS. 8 to 11. The umbrella shaft fitting part $A_2$ of this preferred embodiment is comprised of a sliding cylinder 8 formed with a water storing chamber 10 for storing rain water adhering to the umbrella cloth 2 which drips into it. An umbrella shaft fixing cylinder 9 is installed at one end of the sliding cylinder 8 and a tip end 17 is arranged at an extreme end of the umbrella shaft of the umbrella 1. A water drain cap 23 is fitted at the other end of the sliding cylinder 8 to enable the rain water stored in the water storing chamber 10 to be properly discharged at a desired location.

The aforesaid umbrella shaft fixing cylinder 9 is a cup-like cylinder having, at its central part, a throughhole 15 for the tip end 17. A pair of annular protuberances 11 and 12 are projected at an outer circumference of the cylinder. An annular groove 13 is formed between the annular protuberances 11 and 12, and an annular packing 14 is set within the annular groove 13. At the same time, a water drip passing port 16 is formed at a part below the neck of the cup-like portion of the fixing cylinder 9.

The sliding cylinder 8 is a cylinder which is integrally formed by an upper cylinder 8*a* of large diameter and a lower cylinder 8*b* of small diameter. An annular protuberance 8*c* is projected at an outer circumference of a lower end of the cylinder 8*a* of large diameter.

At a central part of a bottom plate of the cylinder 8*a* of large diameter is arranged an umbrella shaft supporting part 18 to which an extreme end of the tip end 17 projecting through the through-hole 15 is fitted. At the bottom plate surface around the umbrella shaft supporting part 18 is formed an arcuate drain port 19, communicating with the cylinder 8*b* of small diameter. The cylinder 8*b* of small diameter is formed with each of a plurality of drain ports 20, 20 formed so as to be communicated with the inside and outside of the cylinder. A flange part 22 has an outer circumference of its lower edge bulged, and a plurality of abutting protuberances 21, 21 formed on it which cooperate with the flange part 22. The cylinder 8*b* is closed by the water drain cap 23.

The water drain cap 23 is of a double cylinder structure having a cylindrical rib 24 projected at a central part thereof. An opening edge of the outer cylinder of the water drain cap is projected in a radial direction to form an engaging step 26. A part of the engaging step 26 is cut in a radial direction to form cut grooves 25, 25.

The water drain cap 23 is operated such that as the abutting protuberances 21, 21 of the sliding cylinder 8 and the cut groves 25, 25 are positioned to be aligned with each other and the cylindrical rib 24 is fitted into the cylinder member 8*b* of the small diameter, the engaging step part 26 rides over the flange part 22 and is fitted to the sliding cylinder 8.

Figure 9A:
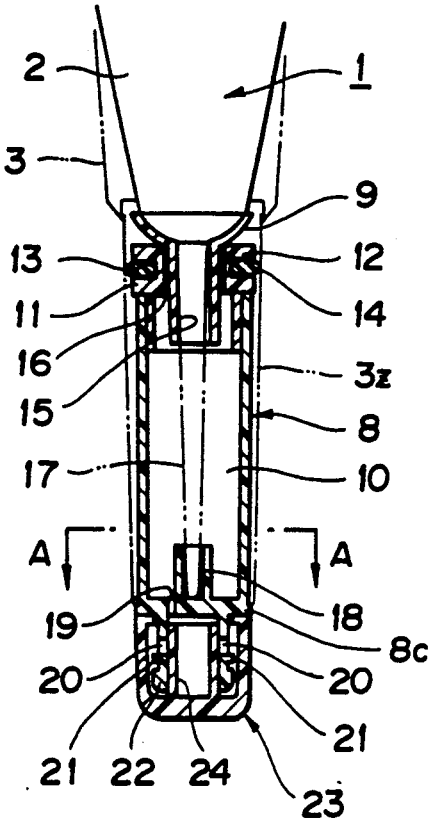
FIG. 9(*a*) is a longitudinal section view of the umbrella shaft fixing part while a water drain cap is pushed thereinto.
Figure 9B:
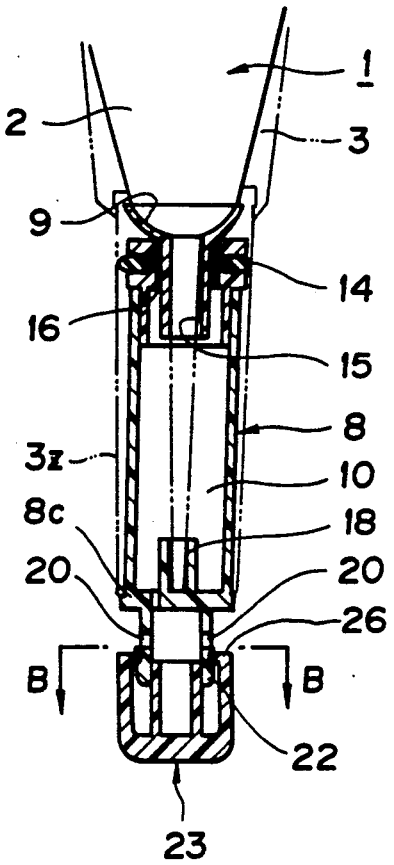
Figure 10:
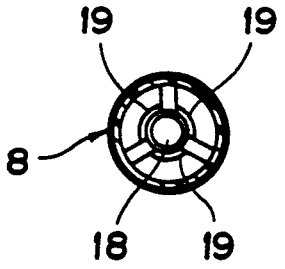
FIG. 10 is a sectional view along a line A—A of FIG. 9.
Figure 11A:
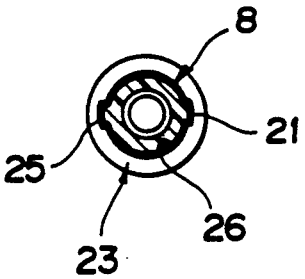
FIGS. 11(*a*) and 11(*b*) are sectional views along a line B—B of FIG. 9.
Figure 11B:
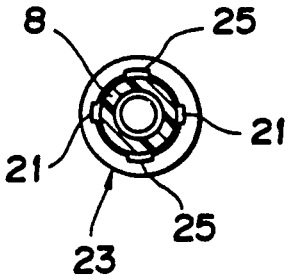

As shown in FIG. 11(*a*), if the fitted water drain cap 23 is pushed or pulled while the abutting protuberance 21, 21 are aligned with the cut grooves 25, 25, it may be slid between a position at which the water drain ports 20, 20 are closed as shown in FIG. 9(*a*) and another position where the water drain ports 20, 20 are opened as shown in FIG. 9(*b*). Further, as the water drain cap 23 is rotated to displace the abutting protuberances 21, 21 from the cut grooves 25, 25, the water drain port 20 can be kept in its opened condition shown in FIG. 9(*b*).

The sliding cylinder 8 is made of hard plastic material, such as ABS resin, for example, and the umbrella shaft fixing cylinder 9 and the water drain cap 23 are made of relatively soft and flexible plastic material, such as polypropylene, for example.

When assembling the umbrella shaft fixing part $A_2$, first, the connecting cover part $A_1$ is retracted. An end part of the upper cylinder 8*a* of the sliding cylinder 8 is received at an opening of small diameter of an innermost connector cylinder 3*z* fixed at the most extreme end thereof. The umbrella shaft fixing cylinder 9, having the packing 14 wound within the annular groove 13 in advance, is received at an opening of the large diameter of the connector cylinder 3*z*. Each of the end parts of the sliding cylinder 8 and the umbrella shaft fixing cylinder 9 is fitted while being press fitted. An adhesive agent is present between these cylinders, and they are connected to each other while being fixed.

With the foregoing arrangement, the connector cover part $A_1$ is also connected to the umbrella shaft fixing part $A_2$. The connected connector cover part $A_1$ is fitted to the umbrella shaft fixing part $A_2$ while an inner projecting edge 4*z*, formed at an extreme end of the connector cylinder 3*z* at the most extreme end side (FIG. 12), is engaged with the annular protuberance 12 while the cover part is in its extended state and engaged with the annular protuberance 8*c* while the cover part is in its retracted state. The connector cylinder 3*z* is slidable between the annular protuberances 12 and 8*c* along an outer circumferential surface of the sliding cylinder 8.

Accordingly, the inner circumferential surface of the connector cylinder 3*z*, at the most extreme end part, slidably contacts the annular packing 14. The packing 14 can be used as a seal to prevent water drops dripping from the umbrella 1 from flowing out along the outer circumferential surface of the sliding cylinder 8.

Figure 12:
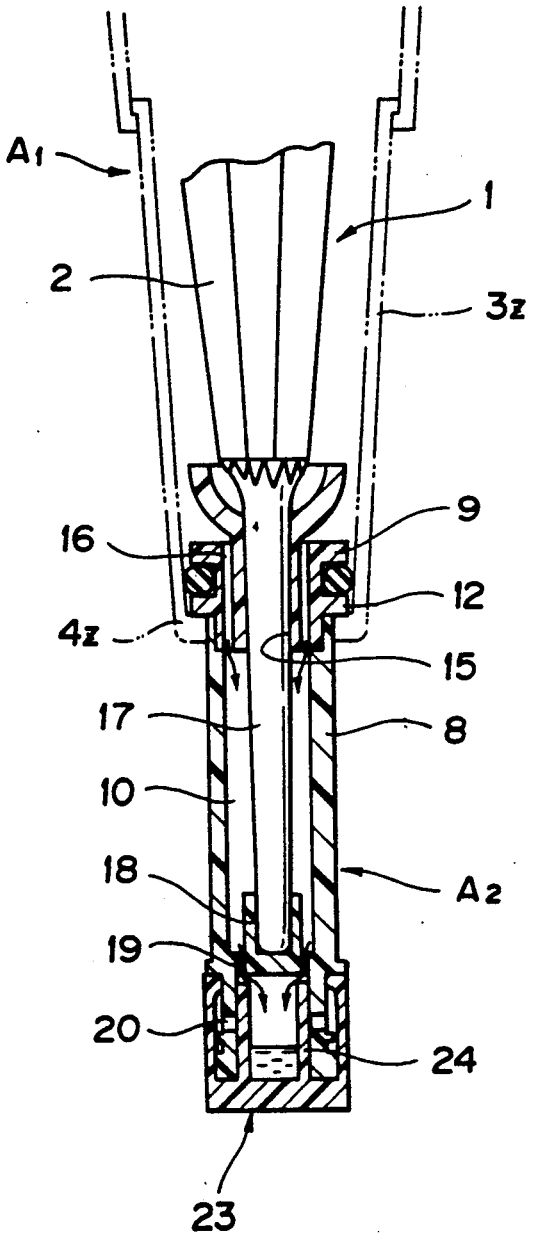
FIG. 12 is a longitudinal section showing a substantial part of the umbrella cover installed in an umbrella while a water drain cap is pushed thereinto.

Also, if the umbrella cover A is fitted to the umbrella 1, the tip end 17 is inserted into the through-hole 15 of the umbrella shaft fixing cylinder 9, which is stored in the connector cylinder 3*z* at its most extreme end, as shown in FIG. 12. The extreme end of the tip end 17 is fitted to the umbrella shaft supporting part 18, and the extreme end of the umbrella cloth 2 is fitted, in a press-fitted state, in a position in which it is seated adjacent a cup-shaped inner surface of the umbrella shaft fixing cylinder 9. The tip end 17 is coated, in advance, with adhesive agent, and both the tip end and the supporting part are connected and placed into a fixed state. Consequently, the umbrella 1 is also connected to the connector cover part $A_1$ through the umbrella shaft fixing part $A_2$.

The umbrella cover A, fixed to the umbrella 1, is operated such that when the umbrella 1 is to be used, the connector cover part $A_1$ is retracted and held at the top end of the umbrella shaft and provides no trouble when opening or closing of the umbrella is performed. After use of the umbrella 1, the connector cover part $A_1$ is extended to cover the outer circumference of the umbrella cloth, which is closed, to provide what is referred to in this specification as a waterproof state. Thus, even if a person contacts the umbrella 1, the clothing worn by that person is prevented from becoming wet.

In addition, the water drops adhering to the umbrella 1 and dripping in sequence from it are stored temporarily in the water storing chamber 10 within the sliding cylinder 8 after passing through the water drip passing port 16. Thus, the rain water can be properly discharged from the a water drain port 20 by opening or closing of the water drain cap 23 at a desired time and a desired place. Details of water draining will be described with reference to FIGS. 12 and 13.

At first, as shown in FIG. 12, the water drain cap 23 is pushed toward the sliding cylinder 8 to close the water drain port 20. The water drops flowing in sequence into the water storing chamber 10, within the sliding cylinder 8, through the passing port 16 and pass through the water drain port 19. The drops are stored in a space within the cylindrical rib 24 of the water drain cap 23. As the space within the cylindrical rib 24 is filled by rain water, causing its water level to be increased, the rain water can be temporarily stored there until at least the water storing chamber 10 is full of water.

Figure 13:
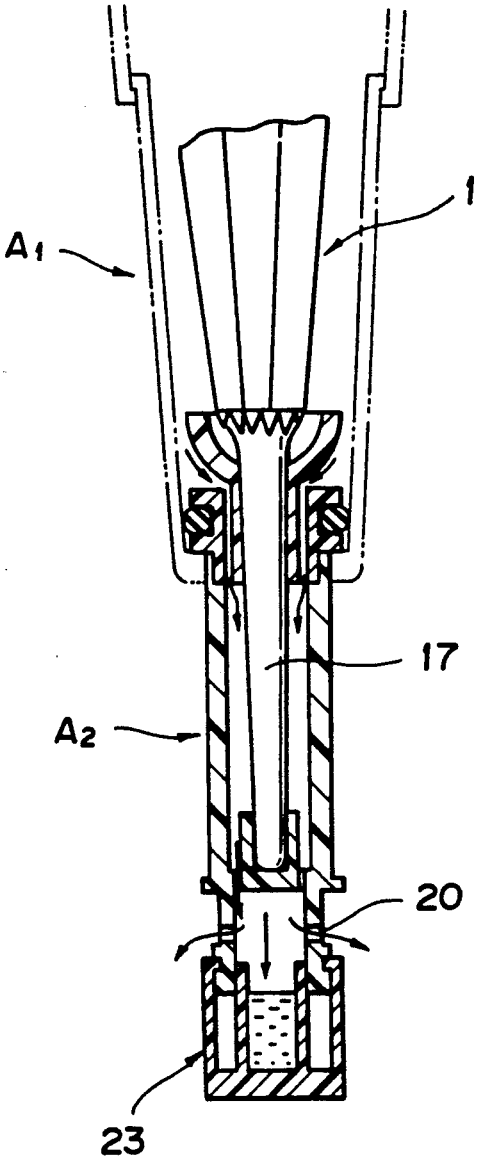
FIG. 13 is a longitudinal section showing a substantial part of an umbrella cover installed in an umbrella while a water drain cap is pulled out thereof.

When the stored rain water is to be discharged, either all at once or in sequence after its storage to a certain degree, the water drain cap 23 is pulled out while being rotated and, as the water drain port 20 is opened, as shown in FIG. 13, the rain water stored in the water storing chamber 10 an the cylindrical rib 24 can be discharged out of the cap.

Figure 14:
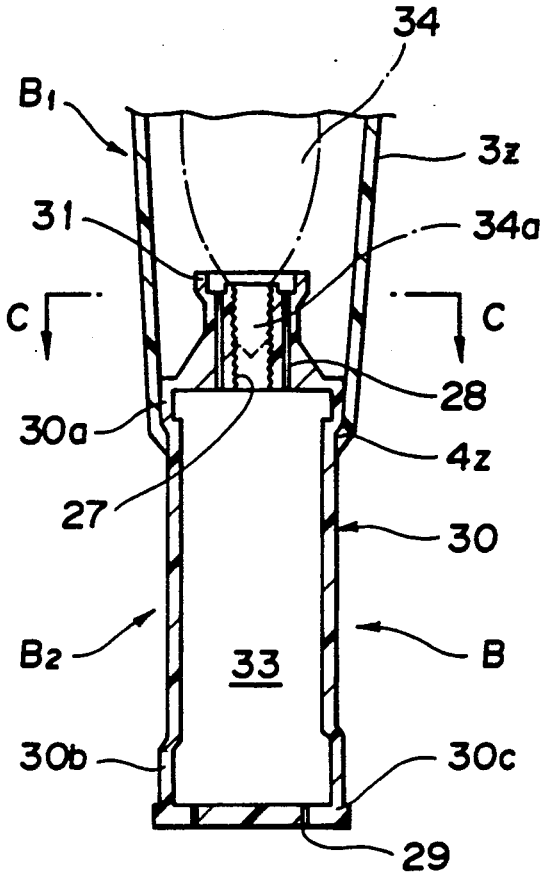
FIG. 14 is a longitudinal section showing a substantial part of an umbrella cover of another preferred embodiment.
Figure 15:
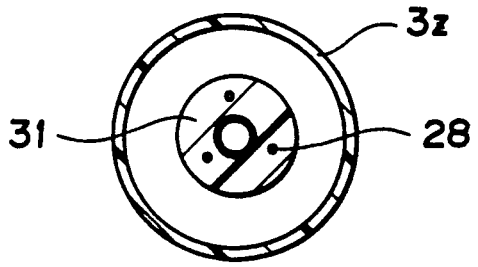
FIG. 15 is a sectional view along a line C—C of FIG. 14.
Figure 16:
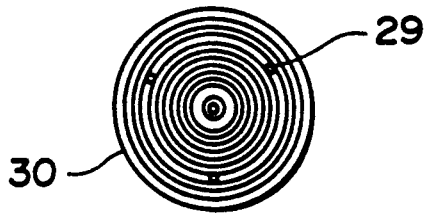
FIG. 16 is a bottom view showing an umbrella cover of FIG. 14.

Referring now to FIGS. 14 to 16, another preferred embodiment of the present invention will be described.

An umbrella cover B of this preferred embodiment is composed of an extending or retracting cover part $B_1$ and an umbrella shaft fixing part $B_2$. Since the extending or retracting cover part $B_1$ has a configuration similar to that of the extending or retracting cover $A_1$ of the previously described preferred embodiment, its detailed description will be eliminated.

The umbrella shaft fixing part $B_2$ is formed by a sliding cylinder 30 and an umbrella shaft fixing cylinder 31. To this sliding cylinder 30 is connected a connecting cylinder 3z installed at the most extreme end of the extending or retracting cover $B_1$. The sliding cylinder 30 is made such that its both upper and lower end outer circumferences are expanded to form annular protuberances 30a and 30c, respectively. Its hollow interior forms a water storing chamber 33 and, at the same time, its bottom surface is formed with drain ports 29 for use in discharging rain water out of the cylinder. In the sliding cylinder 30, a part of the sliding surface formed between each of the annular protuberances 30a and 30c, over which the connecting cylinder 3z slides, is expanded. The expanded part 30b is fitted into the connecting cylinder 3z in its press-fitted state during its retracting operation so as to prevent the extending or retracting cover $B_1$ from sliding off the umbrella.

The umbrella shaft fixing cylinder 31 is provided, at its central part, with an inner thread 27 and a part of the cylinder 31 radially outside of the thread is formed with at least one communicating port 28 communicating with the water storing chamber 33.

The tip end cap is removed from the existing foldable umbrella 34, for example, and its outer thread 34a can be directly threadably engaged with the inner thread 27. Then, the umbrella cover B can be removably fitted to the umbrella 34.

The connector cylinder 3z, at the most extreme end of the extending or retracting cover part $B_1$, is slidably fitted between the annular protuberances 30a and 30c. When extending or retracting the extending or retracting cover part $B_1$, the inner projecting edge 4z of the connecting cylinder 3z is engaged with the annular protuberances 30a and 30c, respectively.

Water drops dripping from the umbrella 34 through the communicating port 28 are sent in sequence into the water storing chamber 33. The rain water is not discharged directly out of the cover, but is stored there temporarily. Then a small amount of water is discharged, in sequence, from within the water storing chamber 33 through the discharging port 29.

The umbrella cover of the present invention is not limited to the aforesaid preferred embodiment. Rather, as shown in FIGS. 17 to 19, various modifications are possible.

Figure 17:
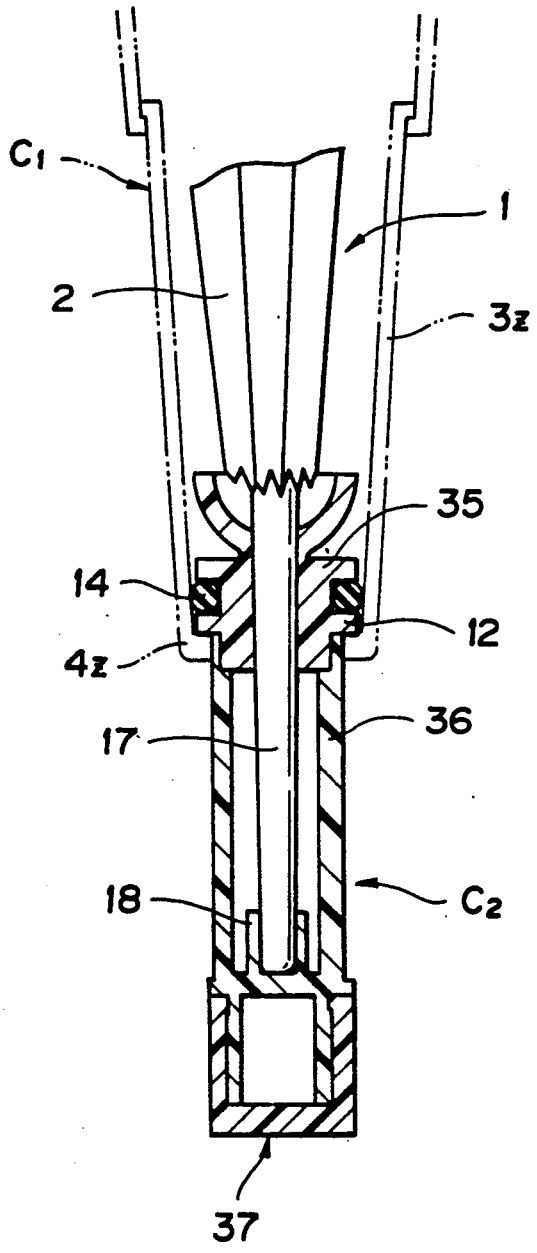
FIGS. 17 to 19 are longitudinal sections showing a substantial part of an umbrella cover of a still further preferred embodiment.

The umbrella cover C shown in FIG. 17 is comprised of an extending or retracting cover part $C_1$, similar to the umbrella cover A of the first preferred embodiment, and an umbrella shaft fitting part $C_2$in which the water storing and discharging mechanisms are removed from the umbrella shaft fixing part $A_2$. The umbrella shaft fixing part $C_2$ includes an umbrella shaft fixing cylinder 35 having a structure without any passing port 16 in the umbrella shaft fixing cylinder 9. An umbrella shaft cover cylinder 36 having no water drain port in the sliding cylinder 8, is provided, and an extreme end cap 37 covers the extreme end of the umbrella shaft cover cylinder 36 and is fixed or not capable of pulling or pushing as was the case in the previously described water drain cap 23.

With this umbrella cover C, the rain water within the extending or retracting cover $C_1$ is discharged in sequence from a spacing in the connection between this connecting cylinder 3z and another connecting cylinder to be connected to the former connecting cylinder when an interior of the most extreme end of the connecting cylinder 3z is filled with water. However, normally the rain water does not accumulate to so great a volume. The umbrella cover C is placed upside down to discharge the rain water.

Figure 18:
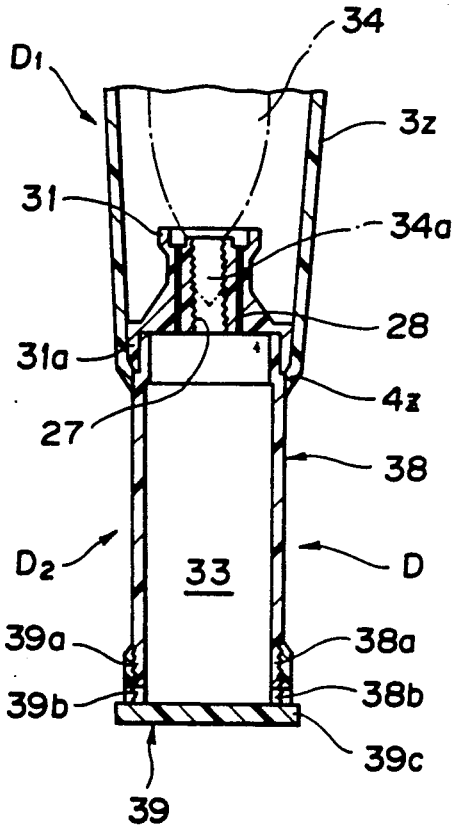
Figure 19:
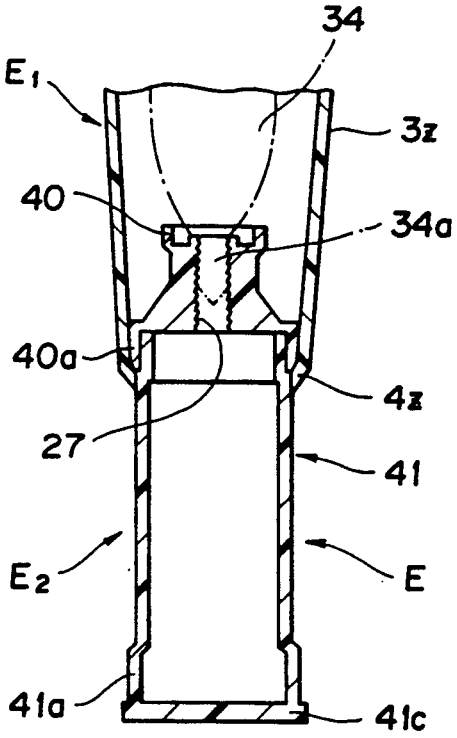

The umbrella cover D shown in FIG. 18 is comprised of an extending or retracting cover $D_1$, similar to the umbrella cover A of the first preferred embodiment, and an umbrella shaft fixing part $D_2$ having an openable or closable water drain cap 39 fitted to the umbrella shaft fixing part $B_2$ of the second preferred embodiment.

In this umbrella cover D, the sliding cylinder 38 is a cylinder having no bottom surface. An outer thread 38a is made at an outer circumference of an end part of the cylinder, and a part of the outer thread 38a is formed with a discharging port 38b. A water drain cap 39 is a cylinder for closing an open end part of the sliding cylinder 38. The water drain cap is comprised of an inner thread 39a, threadably engaged with the outer thread 38a, a discharging port 39b, formed at a part of the inner thread 39a and communicating with the discharging port 38b when rotated, and an annular protuberance 39c with which an inner projecting edge 4z of the most extreme end connecting cylinder 3z is engaged when the extending or retracting cover part $D_1$ is retracted.

Accordingly, if the inner thread 39a and the outer thread 38a are threadably engaged to each other to cause the discharging ports 38b and 39b not to be communicated with each other, rain water is stored within the water storing chamber 33. If the discharging ports 38b and 39b are communicated with each other, the stored rain water can be discharged out of the cylinder.

In this preferred embodiment, the umbrella shaft fixing cylinder 31 and the sliding cylinder 38 are separately made in advance. The umbrella shaft fixing cylinder 31, inserted from the large diameter side of the most extreme end connector cylinder 3z, and the sliding cylinder 38, inserted from the small diameter side of the most extreme end connector cylinder 3z, are fitted to each other. At the same time, an adhesive agent is placed between both of the cylinders to integrally fix them together. With this arrangement, a strong and easily created connection of the umbrella shaft fixing part $D_2$ with respect to the extending or retracting cover part $D_1$ may be formed.

An umbrella cover E, shown in FIG. 19, is comprised of an extending or retracting cover part $E_1$, similar to the umbrella cover B of the second preferred embodiment, and an umbrella shaft fixing part $E_2$, in which the water storing and discharging mechanisms are removed from the umbrella shaft fixing part. This umbrella shaft fixing part $E_2$ is comprised of an umbrella shaft fixing cylinder 40 having no passing port, as was present in the umbrella shaft fixing cylinder 31. An umbrella shaft cover cylinder 41 has no discharging port as was present in the sliding cylinder 30.

In this umbrella cover E, the rain water in the extending or retracting cover part $E_1$ is discharged out of the cylinder in the same manner as that of the umbrella cover C.

The following effects can be expected from the umbrella cover of the present invention.

The extending or retracting cover parts, installed on the umbrella shaft while retracted, is constructed such that the outer projecting edges of the inner connecting cylinders ride over the latching protuberances of the outer connector cylinders and are fitted between the abutting protuberance and the latching protuberance. Thus, the extending or retracting cover is properly maintained by this connecting structure without slipping off in its extending direction. Even if the umbrella is to be opened while the tip top end of the umbrella shaft is placed up, the opening or closing operation is not be prohibited.

In addition, due to the structure of the connector cylinders and the structure for connecting the extending or retracting cover part with the umbrella shaft fixing part, even if a strong force is applied to each of the connected portions when the extending or retracting cover part is disposed over an outer circumference of the umbrella cloth or if the covered extending or retracting cover is removed from the outer circumference of the umbrella cloth in order to extend or retract the cover, each of the connector cylinders is strongly held in such a way as it may not be easily pulled off of the umbrella.

In addition, the water drops which have dripped in sequence from the umbrella can be temporarily stored in the water storing chamber within the sliding cylinder arranged on the umbrella shaft fixing part. Then, the water can properly discharged out of the cylinder, as required by opening or closing the water drain cap. Consequently, a floor can be prevented from becoming wet and the wet umbrella can be stored in any desired place.

Additional features of the present invention are as follows.

(a) The cover can always be portable together with an umbrella while not hindering a person carrying the umbrella. At the same time, the cover can easily be used when required.

(b) Since the connector cylinders are positively stopped and held to each other, the connector cylinders will not be dropped when the cover is to be fitted or removed. Further, the opening or closing of the umbrella may not be hindered by slipping-off of the connector cylinders.

(c) It is possible to cover the wet umbrella cloth so as to prevent the clothing of a person carrying the umbrella or of other persons from being contacted and made wet by the web umbrella.

Although the preferred embodiments of the present invention have been described, it should be understood that the present invention is not limited to the preferred embodiments. Various modifications and applications could be attained without departing from the spirit and the scope of the present invention defined by the claims of this application.

What is claim is:

1. An umbrella cover comprising:

a plurality of connector cylinders having diameters which gradually decrease, in sequence, each of said connector cylinders being press-fitted with at least one other of said connector cylinders to form a telescopic cover, the connector cylinders including an innermost connector cylinder;

a sliding cylinder to be inserted over a tip end of an umbrella, the innermost connector cylinder being mounted for movement along the sliding cylinder, an annular protuberance provided on one end of said sliding cylinder to form a stop for the innermost connector cylinder;

an umbrella shaft fixing cylinder secured to another end of the sliding cylinder opposite said one end; and a pair of annular protuberances provided between said sliding cylinder and said umbrella shaft fixing cylinder so that upward sliding of the innermost connector cylinder is effectively restricted by at least one of the pair of annular protuberances, each of said connector cylinders including an annular outer projection edge at a small diameter end thereof, elongated arcuate abutting protuberances at a large diameter end thereof, and arcuate latching protuberances spaced from but adjacent to the abutting protuberances and the connector cylinders being arranged so that they engage each other by a combination of the annular outer projection edges, said elongated arcuate abutting protuberances and said arcuate latching protuberances so that the umbrella cover operates smoothly and effectively maintains its configuration irrespective of whether the connector cylinders are telescopically expanded or collapsed.

2. An umbrella cover is defined in claim 1, and further comprising an annular inner projection edge provided on the small diameter end of each of said connector cylinders for engaging the annular outer projection edge of an adjacent one of said connector cylinders when said umbrella cover is expanded.

3. An umbrella cover as defined in claim 1, wherein the sliding cylinder forms a water reservoir for storing water dripping from the umbrella in order to prevent an environment from becoming wet.

4. An umbrella cover comprising:

a plurality of connector cylinders having diameters which gradually decrease, in sequence, each of said connector cylinders being press-fitted with at least one other of said connector cylinders to form a telescopic cover, the connector cylinders including an innermost connector cylinder;

a sliding cylinder to be inserted over a tip end of an umbrella, the innermost connector cylinder being mounted for movement along the sliding cylinder, an annular protuberance provided on one end of said sliding cylinder to form a stop for the innermost connector cylinder;

an umbrella shaft fixing cylinder secured to another end of the sliding cylinder opposite said one end; and a pair of annular protuberances provided between said sliding cylinder and said umbrella shaft fixing cylinder so that upward sliding of the innermost connector cylinder is effectively restricted by at least one of the pair of annular protuberances, each of said connector cylinders including an annular outer projection edge of a small diameter end thereof, elongated arcuate abutting protuberances at a large diameter end thereof, and arcuate latching protuberances spaced from but adjacent to the abutting protuberances and the connector cylinders being arranged so that they engage each other by a combination of the annular outer projection edges, said elongated arcuate abutting protuberances and said arcuate latching protuberances so that the umbrella cover operates smoothly and effectively maintains its configuration irrespective of whether the connector cylinders are telescopically expanded or collapsed, wherein the sliding cylinder forms a water reservoir for storing water dripping from the umbrella in order to prevent an environment from becoming wet and the umbrella cover further comprising drain ports formed in said sliding cylinder and a drain cap operable to uncover the drain ports so that water can be discharged from said water reservoir.

* * * * *